US010260468B2

(12) United States Patent
Harter

(10) Patent No.: US 10,260,468 B2
(45) Date of Patent: Apr. 16, 2019

(54) FUEL PIPING ARRANGEMENT IN COMMON RAIL TYPE FUEL SUPPLY SYSTEMS

(71) Applicant: FPT Motorenforschung AG, Arbon (CH)

(72) Inventor: Michael Harter, Meckenbeuren/Reute (DE)

(73) Assignee: FPT MOTORENFORSCHUNG AG, Arbon (CH)

( * ) Notice: Subject to any disclaimer, the term of this patent is extended or adjusted under 35 U.S.C. 154(b) by 121 days.

(21) Appl. No.: 14/894,876

(22) PCT Filed: Jun. 12, 2014

(86) PCT No.: PCT/EP2014/062208
§ 371 (c)(1),
(2) Date: Nov. 30, 2015

(87) PCT Pub. No.: WO2014/198818
PCT Pub. Date: Dec. 18, 2014

(65) Prior Publication Data

US 2016/0102641 A1 Apr. 14, 2016

(30) Foreign Application Priority Data

Jun. 14, 2013 (EP) ..... 13172010

(51) Int. Cl.
*F02M 55/02* (2006.01)
*F02M 39/00* (2006.01)
*F02M 55/00* (2006.01)

(52) U.S. Cl.
CPC ..... *F02M 55/025* (2013.01); *F02M 39/00* (2013.01); *F02M 55/005* (2013.01); *F02M 2200/856* (2013.01)

(58) Field of Classification Search
CPC .... F02M 55/025; F02M 39/00; F02M 55/005; F02M 2200/856; F02M 37/0047;
(Continued)

(56) References Cited

U.S. PATENT DOCUMENTS 5,511,528 A * 4/1996 Iwanaga ..... F02D 41/3836 123/198 DB
7,334,571 B1 * 2/2008 Beardmore ..... F02M 61/14 123/456
(Continued)

FOREIGN PATENT DOCUMENTS

EP 1172551 A2 1/2002
EP 1445474 A1 8/2004
(Continued)

OTHER PUBLICATIONS

Office Action for European Patent Application No. 13172010.4, dated Mar. 4, 2017, 20 pages.

*Primary Examiner* — Hung Q Nguyen
*Assistant Examiner* — Brian P Monahon
(74) *Attorney, Agent, or Firm* — Stetina Brunda Garred and Brucker

(57) ABSTRACT

The present invention provides for a fuel piping arrangement in common rail type fuel supply systems, the supply system comprising at least one common rail and at least one respective injector, wherein the common rail is connected with the at least one injector directly, by means of only one joint.

2 Claims, 3 Drawing Sheets

(58) Field of Classification Search
CPC .... F02M 63/0225; F02M 41/00; F02M 55/02; F02M 55/004; F02M 63/0275; F02M 2200/857
See application file for complete search history.

(56) References Cited

U.S. PATENT DOCUMENTS

| | | | | |
|---|---|---|---|---|
| 7,406,946 | B1 * | 8/2008 | Watanabe | F02M 55/005 123/456 |
| 7,516,735 | B1 * | 4/2009 | Doherty | F02M 55/005 123/468 |
| 2002/0007819 | A1 * | 1/2002 | Nitta | F02F 7/006 123/456 |
| 2004/0094127 | A1 * | 5/2004 | Watanabe | F02M 55/005 123/447 |
| 2008/0042434 | A1 * | 2/2008 | Kenny | F02M 55/004 285/354 |
| 2008/0216798 | A1 * | 9/2008 | Ghelardi | F02M 55/005 123/470 |
| 2008/0264386 | A1 * | 10/2008 | Watanabe | F02M 55/02 123/456 |
| 2009/0134622 | A1 * | 5/2009 | Grandi | F02M 55/005 285/413 |
| 2009/0139595 | A1 * | 6/2009 | Kato | F02M 55/005 138/109 |
| 2009/0179421 | A1 * | 7/2009 | Stieler | F02M 55/004 285/148.19 |
| 2009/0183713 | A1 * | 7/2009 | Bonfigli | F02M 55/005 123/445 |
| 2009/0235899 | A1 * | 9/2009 | Biasci | F02M 55/005 123/470 |
| 2009/0241650 | A1 * | 10/2009 | Kondo | F02M 47/027 73/114.43 |
| 2009/0255511 | A1 * | 10/2009 | Panchal | F02M 55/025 123/456 |
| 2010/0218742 | A1 * | 9/2010 | Fischer | F02M 55/02 123/456 |
| 2010/0258085 | A1 * | 10/2010 | Giorgetti | F02M 55/02 123/470 |
| 2011/0017175 | A1 * | 1/2011 | Grandi | F02M 55/025 123/470 |
| 2011/0174272 | A1 * | 7/2011 | Male | F02M 55/005 123/469 |
| 2014/0231551 | A1 * | 8/2014 | Serra | F02M 61/14 239/584 |

FOREIGN PATENT DOCUMENTS

| | | | |
|---|---|---|---|
| EP | 2354529 | A1 | 8/2011 |
| JP | 2006 233866 | | 9/2006 |
| WO | WO2006092427 | A1 | 9/2006 |

* cited by examiner

FUEL PIPING ARRANGEMENT IN COMMON RAIL TYPE FUEL SUPPLY SYSTEMS

CROSS REFERENCE TO RELATED APPLICATIONS

The present application claims priority to PCT International Application No. PCT/EP2014/062208 filed on Jun. 12, 2014, which application claims priority to European Patent Application No. 13172010.4 filed Jun. 14, 2013, the entirety of the disclosures of which are expressly incorporated herein by reference.

STATEMENT RE: FEDERALLY SPONSORED RESEARCH/DEVELOPMENT

Not Applicable.

FIELD OF THE INVENTION

The present invention relates to a fuel piping arrangement in common rail type fuel supply systems, in particular in the field of heavy vehicles.

DESCRIPTION OF THE PRIOR ART

The fuel supply systems of the common rail type usually comprise a single common pipe for each cylinder bank that supplies the middle or high pressurized fuel.

Such common pipe is disposed horizontally, parallel with the cylinder bank outside the head cover of the engine and, for each injector, a branch pipe connects such injector with the common pipe/rail.

An example is given in EP2354529.

Each of such branch pipes has a limited cross-section due to the desired high pressure of the fuel.

Any inaccuracy of the production of such components, and also the differences among the branch pipes, could induce internal tension during assembly of the entire arrangement and this could lead to leakages and pipe breakage.

SUMMARY OF THE INVENTION

Therefore it is the main object of the present invention to provide a fuel piping arrangement in common rail type fuel supply systems, which overcomes the above problems/drawbacks and increases the safety against leakages into engine oil.

The main principle of the invention is to eliminate the branch pipes and to connect the injectors directly with the common rail, so as the common rail is disposed inside the head cover, close coupled to the injectors.

Several advantages are achieved due to the proposed fuel piping arrangement:

- the leakage risks are strongly reduced or even eliminated,
- during the injection event the fuel pressure inside of injector can significantly drop due to the limited transversal internal section of the branch pipes, thus the average injection pressure is significant lower than the rail pressure set point of the common rail: the direct connection of the common rail with the injectors, according to the present invention, minimizes pressure drops along the fuel path rail to injectors. This increases, at same hydraulic length of injection, the fuel introduction into the engine cylinder. The stored fuel in the high pressure volume, the common rail, close to the injectors improves the dynamic pressure behavior in the supply path to the injectors. Reduced pressure oscillations allow an improved precision for fuel metering, especially in multi-injection mode, namely during the close coupled injections, like pilot-main-post-injections, well known per sé.

These and further objects are achieved by means of an arrangement as described in the attached claims, which form an integral part of the present description.

BRIEF DESCRIPTION OF THE DRAWINGS

The invention will become fully clear from the following detailed description, given by way of a mere exemplifying and non limiting example, to be read with reference to the attached drawing figures, wherein.

The same reference numerals and letters in the figures designate the same or functionally equivalent parts.

DETAILED DESCRIPTION OF THE PREFERRED EMBODIMENTS

Figure 1:
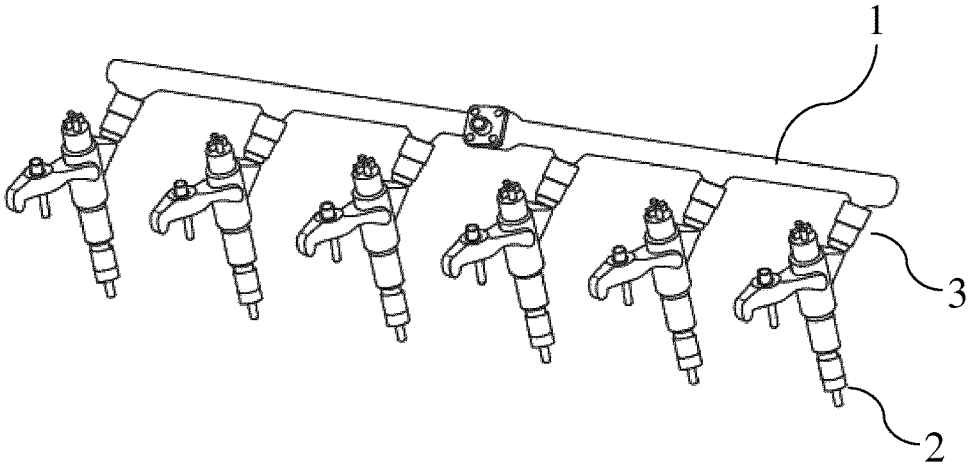
FIG. 1 shows a perspective view of a fuel piping arrangement according to the present invention: it is clear that the branch pipes are not present and the common rail is connected directly with the injector ports; The common rail attachment close to the injectors may require also a dedicated connector design.

According to the present invention, the common rail 1 is directly connected with the input port 3 of the injector 2.

The common rail 1 runs horizontally, parallel with an engine bank B.

The type of joint for connecting the common rail 11 with the injector input port 21 can be any. The absence of any kind of branch pipe means that only one joint is present between the common rail and the injector, by bringing the respective ports joined together.

FIG. 1 shows six injectors aligned along a direction, with the common rail directly connected with the injectors.

Figure 2:
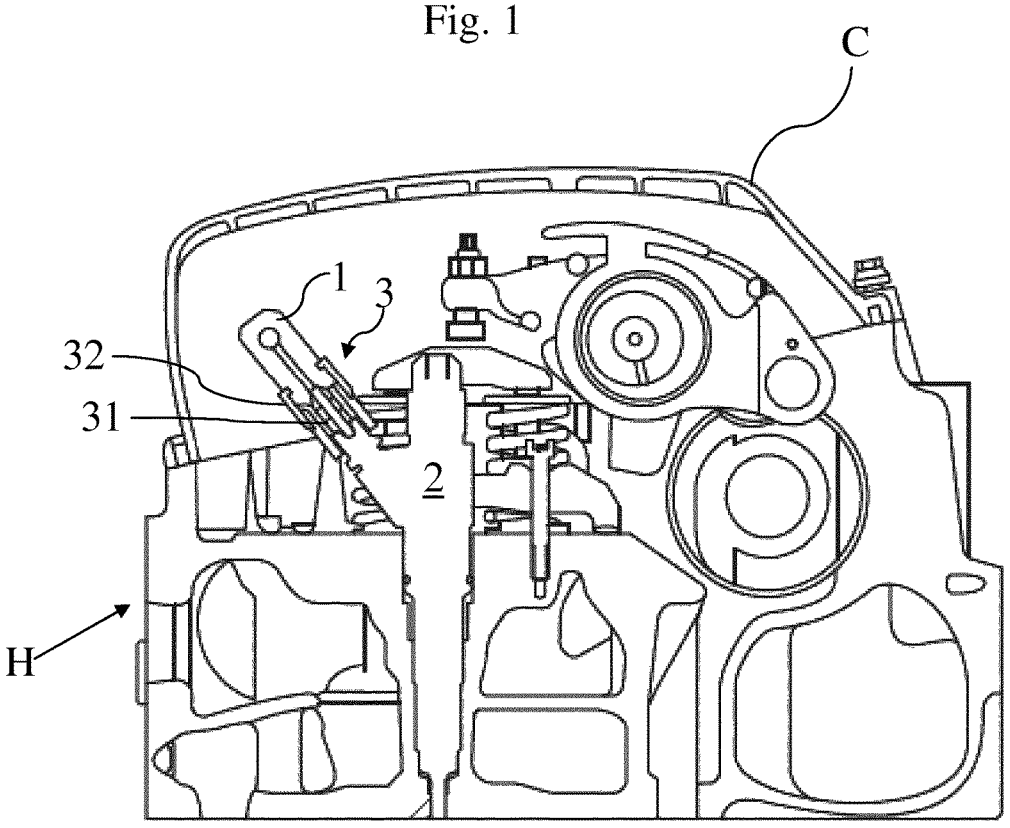
FIGS. 2, 2*a* show a side cross-sectional view and a zoom of a portion of an engine bank, showing the common rail disposed inside the cylinder head cover.
Figure 2A:
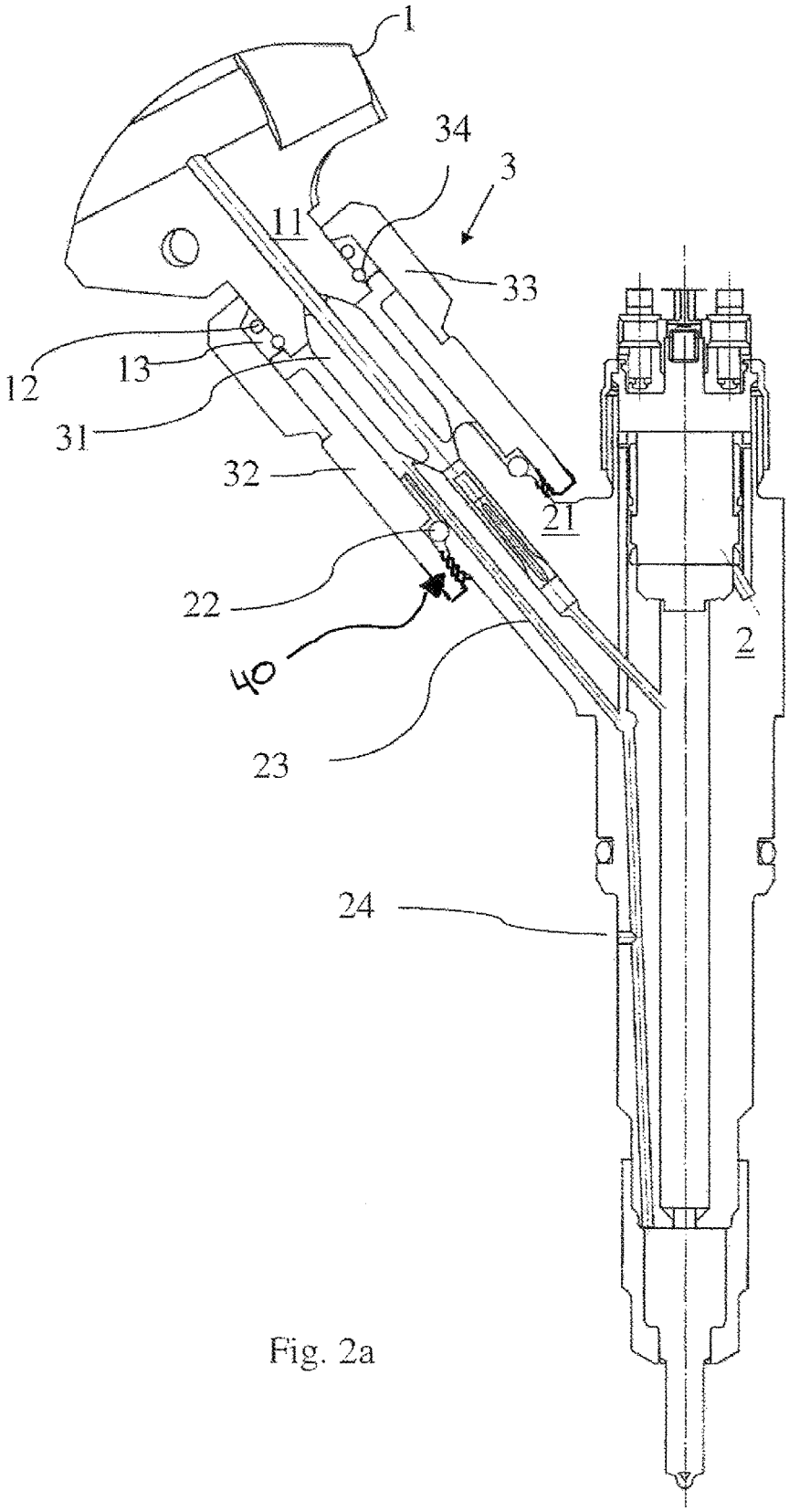

FIGS. 2 and 2*a*, show a cross-sectional view of an engine head, drawn perpendicularly with respect to the common rail alignment and passing through one of the several injectors 2. Therefore, the cross-sectional view is longitudinal with respect to the injector development.

Having, usually, either the common rail port or the input port 21 of the injector a concave shape, an adapting element 31 can be interposed between the input port and the common rail port. However, such adapting element can be absent, if the common rail port has a shape complementarily with respect to the shape of the injector port and vice versa. The common rail port and the input port of the injector are brought fixed together through a single tubular joint 3. Therefore, the mechanical connection is operated directly between the common rail and the injectors.

A first end of the tubular joint 3, is clamped on a shaped ring 13 annularly surrounding the common rail port. Thus, preferably, the joint can rotate around the rail port 11 development axis, while being fixed axially.

The second end, opposite to the first end, of the joint 3 can be screwed on the injector port 21 to form a threaded connection 40.

According to a preferred embodiment of the present invention, the tubular joint 3 comprises two concentric tubular pieces axially fixed between each other 32 and 33.

The double walled configuration obtained by said kind of joint further reduces the leakage risks.

They can be connected with each another by screwing or by welding or through a press-fit connection. Preferably, the joint is made of one single component.

According to a preferred embodiment of the invention, the ring is fixed on the common rail port 11 through an annular trapped spring 34 working on two complementary grooves: one, outwardly, on the common rail port 11 and one on the inner surface of the ring 13.

Other solutions can be implemented in order to couple directly the common rail port with the injector port.

The shaped ring 13 could comprise also a seal ring 12 interposed between the outer surface of the common rail port 11 and the inner surface of the ring 13, order to make hermetic the connection between the common rail port and the upper end of the joint 3.

A further seal 22 can be present and interposed between the injector port 21 and the joint 3.

It should be noted that the adapting element bears only an axially compression strain due to the action of the single tubular joint 3. Instead, for the known arrangements, the branch pipes having a first end connected with the common rail port and the second end connected with injector port are subjected to stretching strains due to the internal fuel pressure that could cause fuel leakage.

According to a preferred embodiment of the present invention the joint 3 is direct machined with the common rail 1 or with the injector 2. In such a case, the common rail port and the injector port could be complementary, so as to be joined without the interposition of the adaptation element 31.

Furthermore, at the joint 3 is present the input mouth of the flow-back channel 23, which collects the fuel leakage at the joint and feed it through the injector body and then through the cylinder head—see the exit mouth 24 of the channel 23—until a low pressure portion of the fuel injection system. Further solution can be implemented for collecting the fuel leakage.

According to the example of FIG. 2, it is clear that the common rail is disposed inside the head cover C, thus it is contained between the engine head H and the head cover C.

Figure 3:
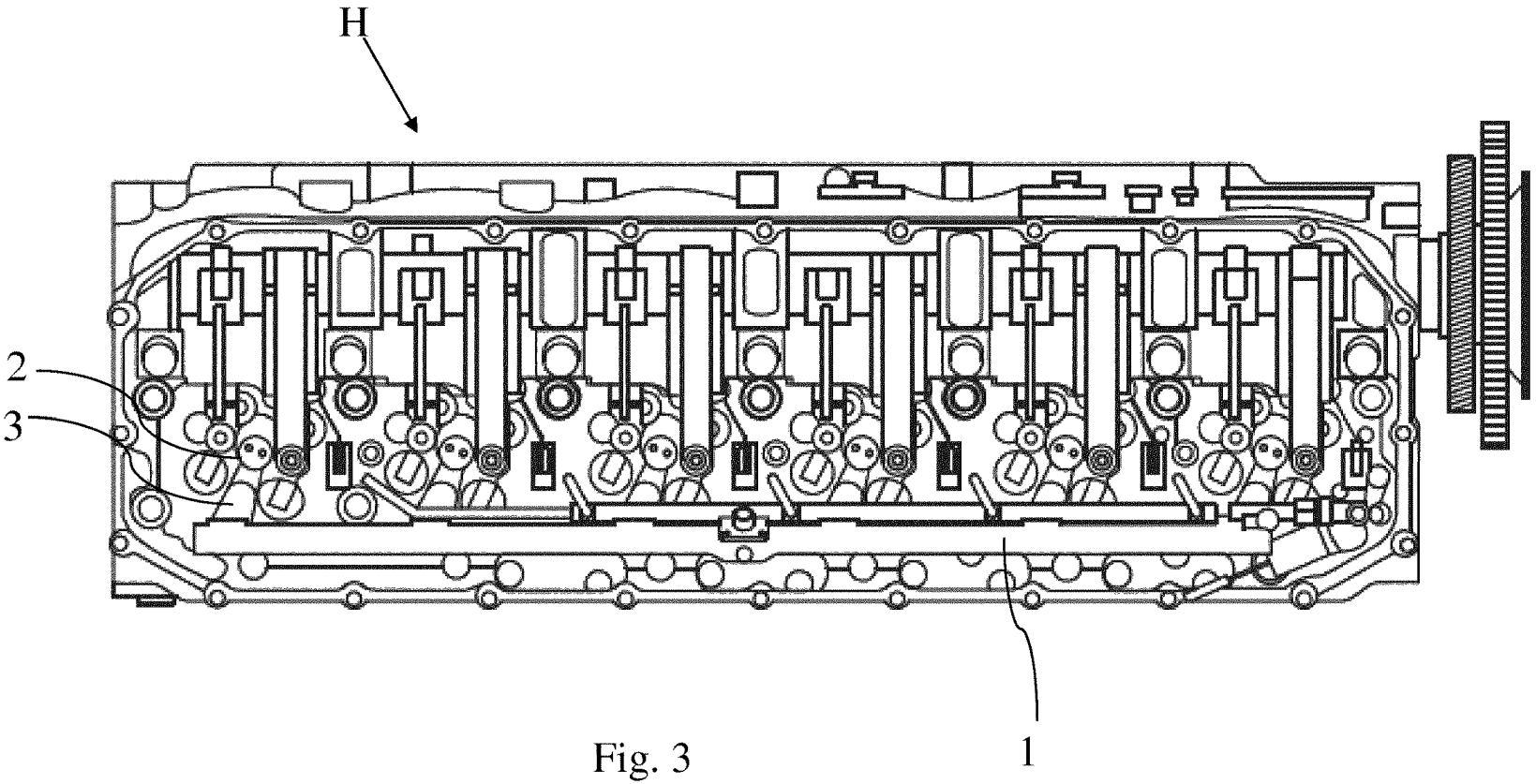
FIG. 3 shows a top view of the same engine bank shown on FIG. 2, where the head cover is removed.

FIG. 3 shows a top view of the same bank of FIG. 2, where the head cover C is removed.

Many changes, modifications, variations and other uses and applications of the subject invention will become apparent to those skilled in the art after considering the specification and the accompanying drawings which disclose preferred embodiments thereof. All such changes, modifications, variations and other uses and applications which do not depart from the spirit and scope of the invention are deemed to be covered by this invention.

Further implementation details will not be described, as the man skilled in the art is able to carry out the invention starting from the teaching of the above description.

The invention claimed is:

1. A fuel piping arrangement in a common rail type fuel supply systems, the supply system comprising at least one common rail and at least one respective injector having an injector port, wherein the common rail is connected with the at least one injector directly, by means of only one tubular joint characterized in that said only one tubular joint includes two concentric components axially fixed between each other, the two concentric components defining a common bore and the tubular joint further including a first end clamped on an annular shaped ring, the annular shaped ring surrounding a common rail port and a second end, opposite to the first end, of the tubular joint includes a first set of threads, the first set of threads threadable with a second set of threads on the injector port; wherein the annular ring does not directly contact the injector port; and further comprising a sealing element interposed between said common rail port and said annular ring.

2. A fuel piping arrangement in a common rail type fuel supply systems, the supply system comprising at least one common rail and at least one respective injector having an injector port, wherein the common rail is connected with the at least one injector directly, by means of only one tubular joint characterized in that said only one tubular joint includes two concentric components axially fixed between each other, the two concentric components defining a common bore and the tubular joint further including a first end clamped on an annular shaped ring, the annular shaped ring surrounding a common rail port and a second end, opposite to the first end, of the tubular joint includes a first set of threads, the first set of threads threadable with a second set of threads on the injector port; wherein the annular ring does not directly contact the injector port; and wherein said injector port further comprises another sealing element, operatively interposed between said injector port and said second end of the tubular joint.

* * * * *